US006494193B2

(12) United States Patent
Weingaertner et al.

(10) Patent No.: US 6,494,193 B2
(45) Date of Patent: Dec. 17, 2002

(54) ENGINE COVER WITH INTEGRATED IGNITION SYSTEM

(75) Inventors: Juergen Weingaertner, Karlsbad (DE); James D. Lykowski, Temperance, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/056,266

(22) Filed: Jan. 25, 2002

(65) Prior Publication Data

US 2002/0162545 A1 Nov. 7, 2002

Related U.S. Application Data

(60) Provisional application No. 60/264,597, filed on Jan. 26, 2001.

(51) Int. Cl.[7] ..... F02P 15/00

(52) U.S. Cl. ..... 123/647; 123/143 C

(58) Field of Search ..... 123/647, 143 C, 123/143 R, 594, 169 PM

(56) References Cited

U.S. PATENT DOCUMENTS

| | | | |
|---|---|---|---|
| 2,488,096 | A | 11/1949 | Newman |
| 2,509,093 | A | 5/1950 | Field |
| 4,637,368 | A | 1/1987 | Gillbrand et al. |
| 4,669,443 | A | 6/1987 | Oetting et al. |
| 4,706,638 | A | 11/1987 | Johansson et al. |
| 4,706,639 | A | 11/1987 | Boyer et al. |
| 4,903,675 | A | 2/1990 | Huntzinger et al. |
| 5,109,828 | A | 5/1992 | Tagami et al. |
| 5,152,274 | A | 10/1992 | Maekawa |
| 5,218,936 | A | 6/1993 | Pritz et al. |
| 5,349,930 | A | 9/1994 | Maruyama et al. |
| 5,357,931 | A | 10/1994 | Semence |
| 5,390,648 | A | 2/1995 | Yanase |
| 5,598,824 | A | 2/1997 | Teusch et al. |
| 5,743,235 | A | 4/1998 | Lueder |
| 5,771,850 | A | 6/1998 | Okada |
| 6,053,148 | A | 4/2000 | Glovatsky et al. |
| 6,328,010 | B1 * | 12/2001 | Thurman ..... 123/143 C |

* cited by examiner

*Primary Examiner*—Bibhu Mohanty
(74) *Attorney, Agent, or Firm*—Reising, Ethington, Barnes, Kisselle, Learman & McCulloch, P.C.

(57) ABSTRACT

An engine cover with integrated ignition system components that provides a protective enclosure for ignition coils in a distributorless ignition system of an internal combustion engine. The cover serves as a cylinder head cover for sealing over the valve assembly of the engine and for that purpose includes a plastic housing having an upper wall and side walls that extend downwardly to a perimeter mounting surface of the housing. The housing includes a unitary compartment that is located above the upper wall. The ignition coils are mounted within the compartment and are electrically connected via terminals to high voltage leads that are embedded in the upper wall and that extend laterally to a corresponding second group of terminals located at the lower surface of the upper wall. These terminals are positioned so as to electrically connect to the engine spark plugs when the cover is installed on the engine.

19 Claims, 6 Drawing Sheets

ENGINE COVER WITH INTEGRATED IGNITION SYSTEM

CROSS-REFERENCE TO RELATED APPLICATION

This application claims the priority of U.S. Ser. No. 60/264,597 filed Jan. 26, 2001, the entire contents of which are hereby incorporated by reference.

TECHNICAL FIELD

This invention relates to engine fluid compartment covers and ignition systems for spark ignition internal combustion engines.

BACKGROUND OF THE INVENTION

Spark ignition internal combustion engines such as are used in automobiles have traditionally employed mechanical or electronic distributors to route high voltage spark energy from an ignition coil to the engine spark plugs. More recently, distributorless ignition systems have been employed in which a separate ignition coil is provided for every one or two spark plugs. In some instances, the coils are installed directly above or into the spark plug. In other instances they are integrated together into a common housing or assembly for installation above the spark plugs as a single unit, and this integrated approach has been proposed for both distributor-based and distributorless systems.

For example, U.S. Pat. No. 4,669,443 to Oetting et al. discloses an integrated ignition system in which a cylinder head cover mates with the engine to define a first enclosed cover space for the valve assembly overhead cam and a second enclosed space for the spark plugs. The cover can include a distributor and ignition coil with leads that route the high voltage to annular contact rings electrically connected to the spark plugs. U.S. Pat. No. 5,743,235 to Lueder discloses an air intake manifold having a distributor and molded-in high voltage wires that lead to external lugs where they are then connected to each spark plug via spark plug wires.

In distributorless systems, a number of different approaches have been proposed for incorporating the ignition coils into a common assembly. For example, U.S. Pat. No. 5,771,850 to Okada discloses different embodiments of a cylinder head cover that includes for each spark plug an ignition coil mounted either under the cover or in an exposed location on the top of the cover. The cover includes either a printed circuit or embedded conductors that provide power to the coil primary from a connector on the cover. Although this design involves a fairly direct connection of the coil's high voltage secondary to the spark plugs, it is also known in distributorless systems to route the high voltage from the coil to the spark plugs using molded-in high voltage conductors. This is shown in U.S. Pat. No. 4,706,639 to Boyer et al. In that patent, the ignition module includes a plastic housing that includes the ignition coils in a central location with conductors embedded in a lower wall of the housing to carry the high voltage from the coils to terminals located on the bottom side of the lower wall. The terminals are electrically connected to the spark plugs via a spring or conductive material. The housing includes a metal cover which partially extends over a pair of separate dual-overhead cam covers.

Various other approaches to an integrated ignition system have been proposed. U.S. Pat. No. 4,903,675 to Huntzinger et al. discloses an integrated ignition system which includes a primary winding module that comprises a horizontal support portion and a plurality of downwardly-extending spaced tubular extensions, each of which has a primary winding coil open at its lower end so that it can fit directly onto its associated spark plug. Each spark plug includes a high voltage secondary so that when the primary winding module is installed with each of the tubular extensions fitted over its associated spark plug, the primary windings in the tubular extensions surround and magnetically couple to the secondary windings in the spark plug to thereby transfer spark energy to the secondaries. See also, U.S. Pat. No. 5,109,828 to Tagami et al.; U.S. Pat. No. 5,152,274 to Maekawa; U.S. Pat. No. 5,218,936 to Pritz et al.; and U.S. Pat. No. 5,390,648 to Yanase.

Although these prior art systems provide integration of various portions of the ignition system, they typically provide only limited integration or otherwise involve a tradeoff of modularity and ease of servicing for increased integration. For example, in the Boyer et al. patent, the housing and cover of the ignition module is separate from the cam covers. In the Oetting et al. patent, the distributor and ignition coil appear as an integral part of the cylinder head and apparently not separately replaceable. The Okada cylinder head cover involves locating the ignition coils either under the cover, where they are not easily accessible, or on top of the cover, where they are completely exposed and not protected. In either case, the coils are located directly above their associated spark plug and no provision is made for allowing them to be located in a laterally-spaced position on the cylinder cover.

SUMMARY OF THE INVENTION

The present invention is directed to an engine cover such as can be used for sealing engine oil or some other engine fluid within a compartment on a spark ignition internal combustion engine. The cover can be, for example, a rocker cover or, more generally, an overhead valve assembly cover. In accordance with one aspect of the invention, the cover comprises an engine fluid compartment cover that includes a housing, a first group of high voltage terminals, a second group of high voltage terminals, and a plurality of high voltage leads electrically connecting each terminal from the first group with at least one of the terminals from the second group to thereby permit high voltage spark energy to be transmitted through said housing. The housing has an upper wall and at least one side wall extending down from the upper wall to a mounting surface of the housing. The mounting surface has a conformation that mates with an associated surface of an engine fluid compartment on the engine such that, when the housing is mounted to the engine with the mounting surface in contact with its associated surface on the engine fluid compartment, the upper and side walls together enclose the engine fluid within an interior region below the upper wall. The first group of terminals are located at the outer surface of the upper wall and the second group of terminals are located at the inner surface of the wall. In this way, ignition coils or other ignition system components can be located on the outside of the cover in contact with the first group of terminals and the high voltage spark energy can then be routed through the housing by the high voltage leads to the second group of terminals that can be electrically connected to the individual spark plugs.

In accordance with another aspect of the invention, the cover can include a housing as described above, but with a separate compartment located above the upper wall to provide a protective enclosure for the ignition coils and/or other components. The first group of terminals can then each be located within the compartment, and a removable cover can be provided over the compartment. This serves the dual purpose of maintaining the high voltage portion of the ignition system within and underneath the housing while providing easy access to the ignition coils for servicing.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
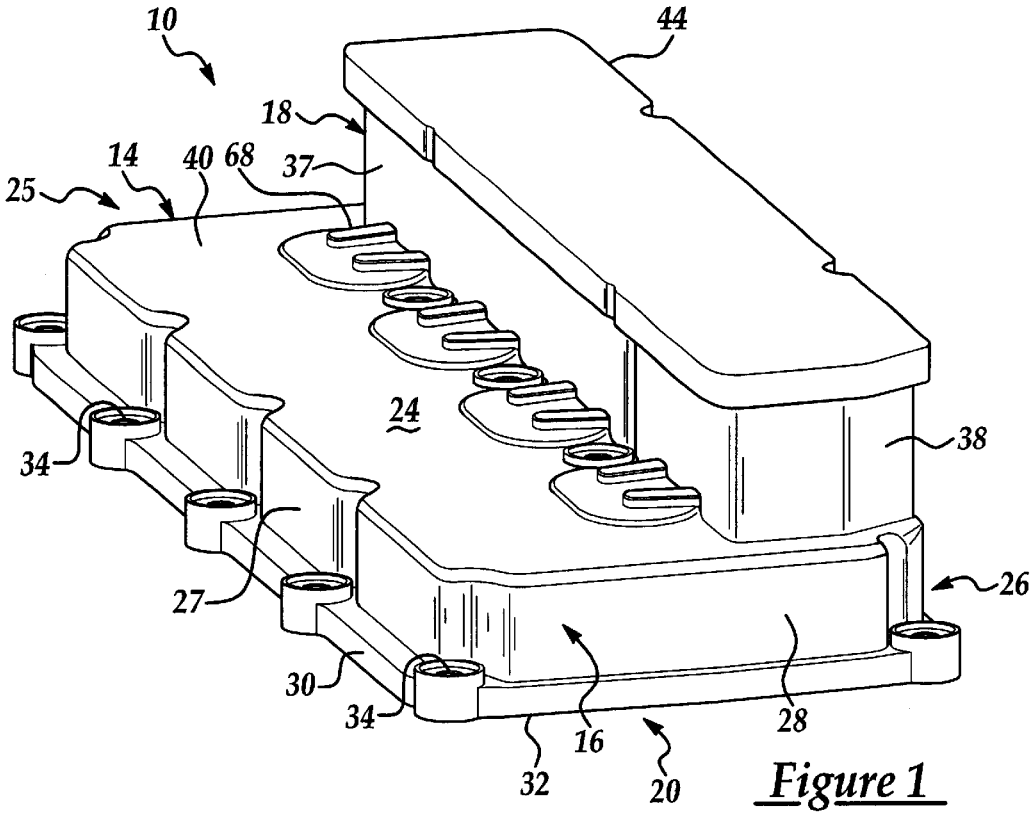
FIG. 1 is a perspective view of a preferred embodiment of a rocker cover of the present invention.
Figure 2:
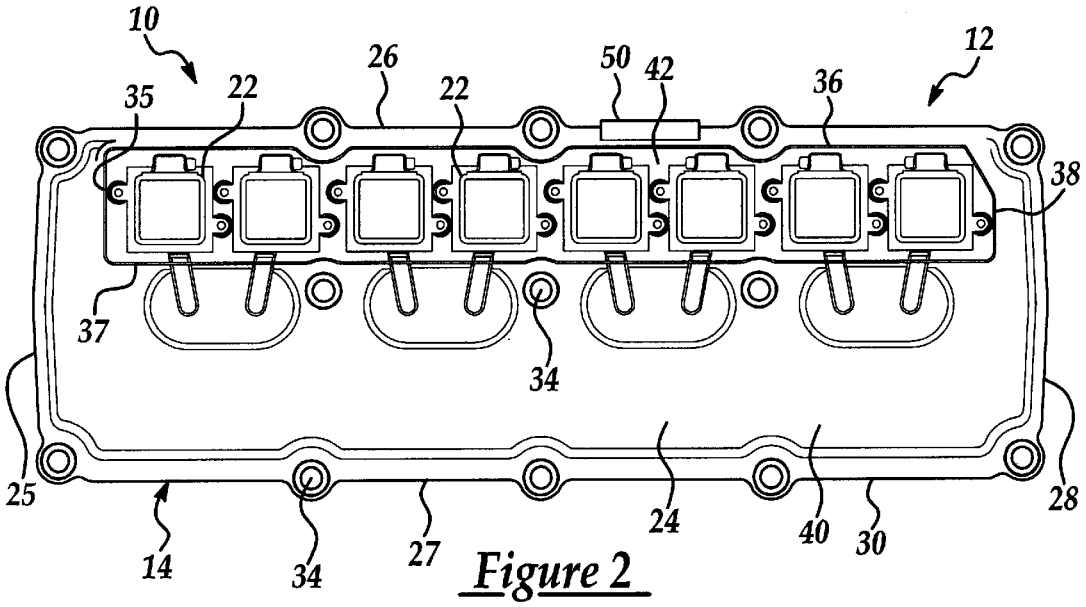
FIG. 2 is a top view of the rocker cover of FIG. 1 with its coil compartment lid removed.
Figure 3:
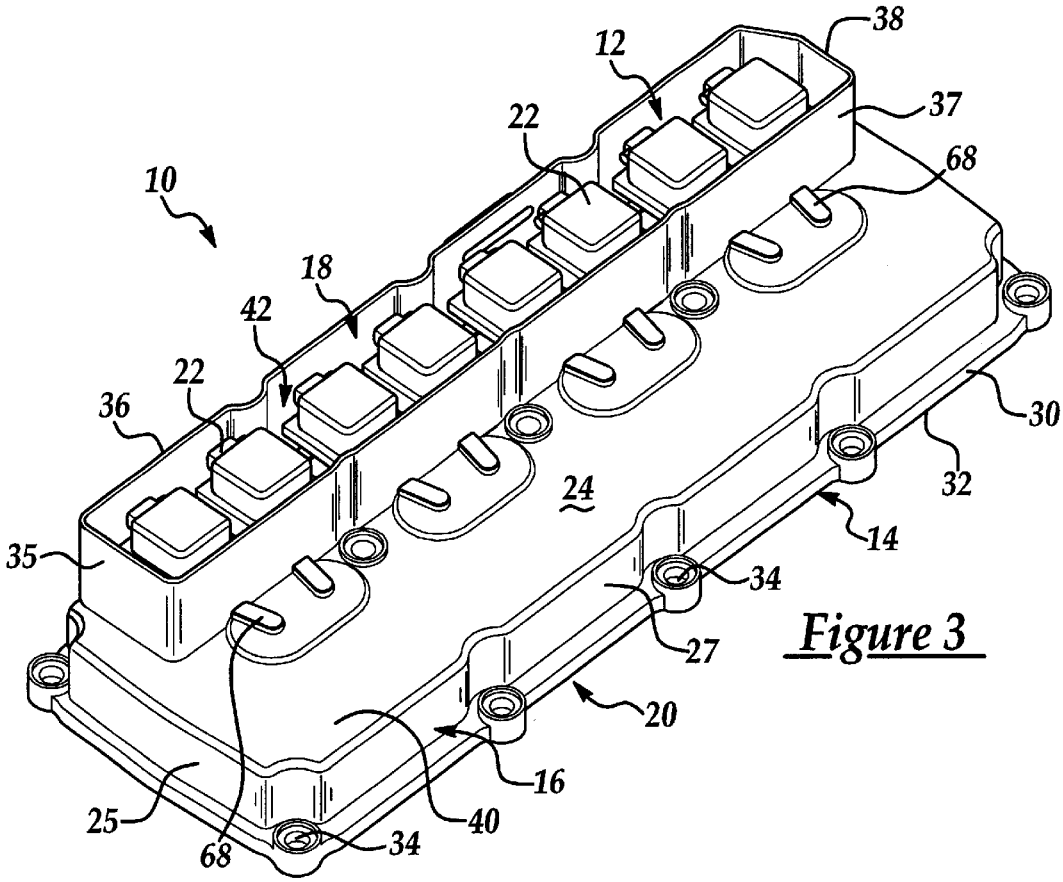
FIG. 3 is a top perspective view of the rocker cover of FIG. 2.

Referring to FIGS. 1–3, there is shown a rocker cover 10 having a high voltage ignition system 12 integrated into the cover 10. In general, rocker cover 10 comprises a molded plastic housing 14 having a lower portion 16 and an upper portion 18. Rocker cover 10 is designed for use with a spark ignition internal combustion engine (not shown) of the type that uses rocker arms to actuate the valves that permit fluid flow into and out of the engine's cylinders. As will be appreciated, lower portion 16 is used to seal the rocker arms and engine oil within an interior space 20 below the rocker cover 10 when it is assembled onto the engine. Ignition system 12 includes an ignition coil 22 for each of the spark plugs used in the engine, as well as high voltage leads molded into the housing 14 to carry the spark energy from each coil to its associated spark plug. Of course, the complete vehicle ignition system will include other components that are not integrated into the rocker cover 10, such as an ignition switch and drive circuitry for the ignition coils. All of these other components and their use is well within the knowledge of those skilled in the art.

The coils 22 are mounted in the upper portion 18 which functions as a coil compartment. As will be discussed in greater detail further below, the high voltage leads are molded inside the rocker cover housing walls and extend from a location within the coil compartment 18 to a location within the lower portion 16. The high voltage leads thus transmit the high voltage spark energy through the housing from an exterior location to an interior location. In this way, the functions of a rocker cover and the high voltage portion of a vehicle ignition system can be incorporated together with the coils being located in an easily-accessible exterior location and the high voltage being contained within and underneath the rocker cover.

Before describing the high voltage components in detail, continued reference is made to FIGS. 1–3, in which the rocker cover 10 is shown as including a horizontally-extending upper wall 24. In the illustrated embodiment, this upper wall 24 has a generally rectangular shape with a side wall 25–28 extending downward from each edge of the upper wall 24 and together terminating at a peripheral flange 30. This peripheral flange has a lower mounting surface 32 that provides a fluid-tight seal to prevent the escape of engine oil. When assembled onto an engine, mounting surface 32 is placed in contact with a complementary surface of the engine, either directly or via a gasket, and the upper and side walls 24–28 enclose the engine's rocker arms within the interior space 20 below upper wall 24. A plurality of mounting holes 34 are spaced about flange 30 and centrally about upper wall 24 for bolting of the cover to the engine.

Coil compartment 18 is located above upper wall 24 and is defined by four side walls 35–38 that extend upwardly from an outer surface 40 of the upper wall. Together with upper wall 24, these side walls provide an interior space 42 sized to hold the ignition coils 22. As shown in FIG. 1, a cover or lid 44 is snapped or otherwise attached over interior space 42 to provide environmental protection to the coils within compartment 18.

Figure 4:
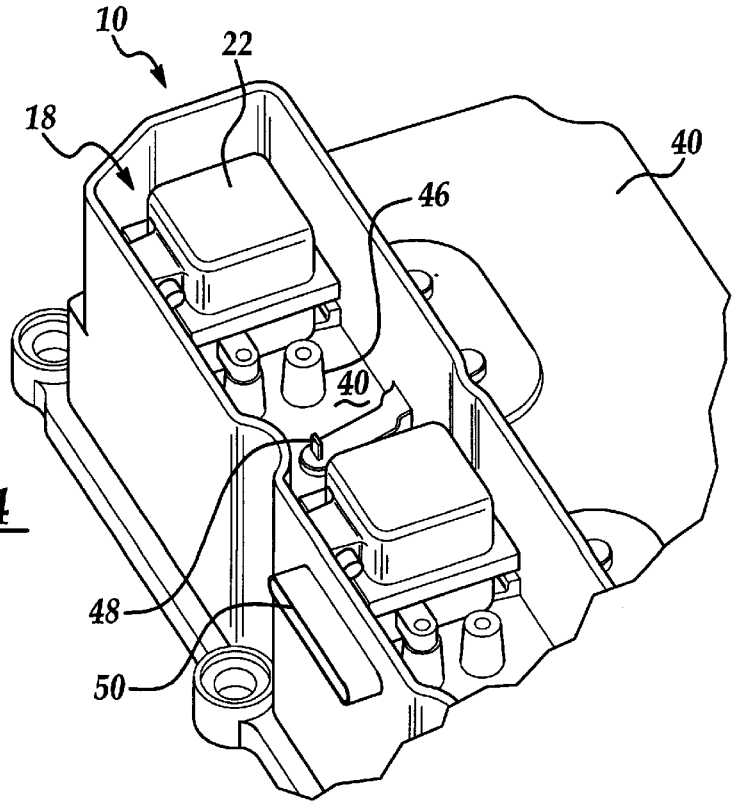
FIG. 4 is an enlarged, fragmentary, top perspective view of the rocker cover of FIG. 2.

Referring now to FIG. 4, further details of the coil compartment 18 and mounting of the ignition coils 22 is shown. For purposes of clarity, only every other coil is shown mounted within the compartment. Each coil can be mounted within the compartment in a conventional fashion and, as shown, is mounted on the outer surface 40 using posts 46 and screws (not shown). Each coil connects to one of a group of high voltage terminals 48 that protrude upwardly from outer surface 40. Each terminal 48 can be, for example, a metal terminal blade that makes electrical connection with a suitable receiving terminal (not shown) on its associated coil 22 when the coil is inserted in place within the compartment 18. Other terminal and electrical connection arrangements can be used, such as is described further below in connection with FIGS. 8–12. Side wall 36 includes a connector opening 50 within which a suitable electrical connector (not shown) can be mounted for feedthrough into the compartment of the drive power used to energize the ignition coil primary windings.

Figure 5:
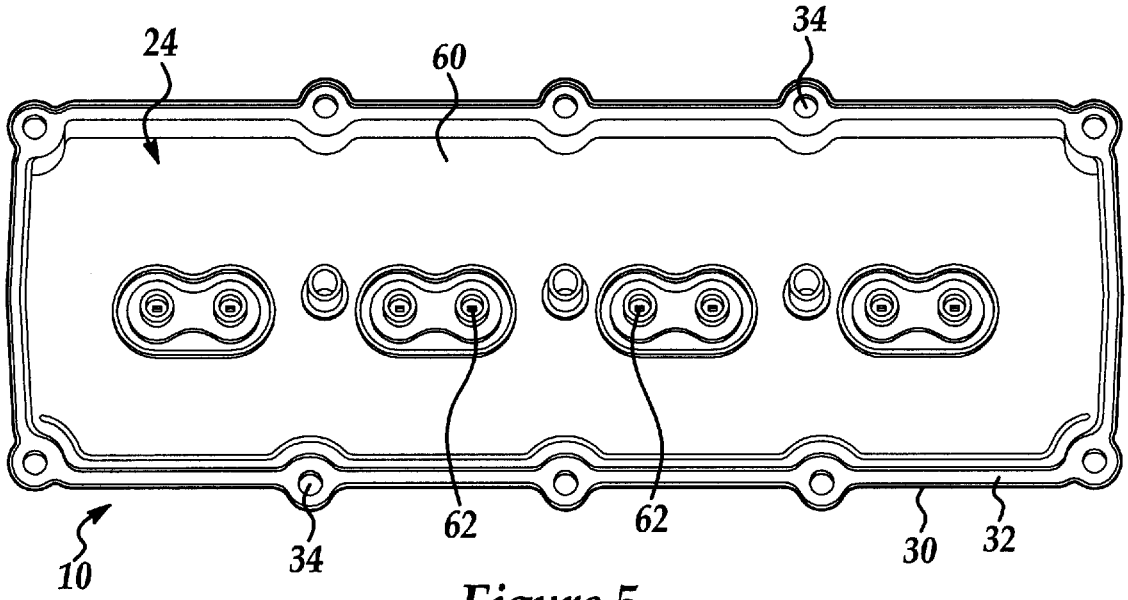
FIG. 5 is a bottom view of the rocker cover of FIG. 1.
Figure 6:
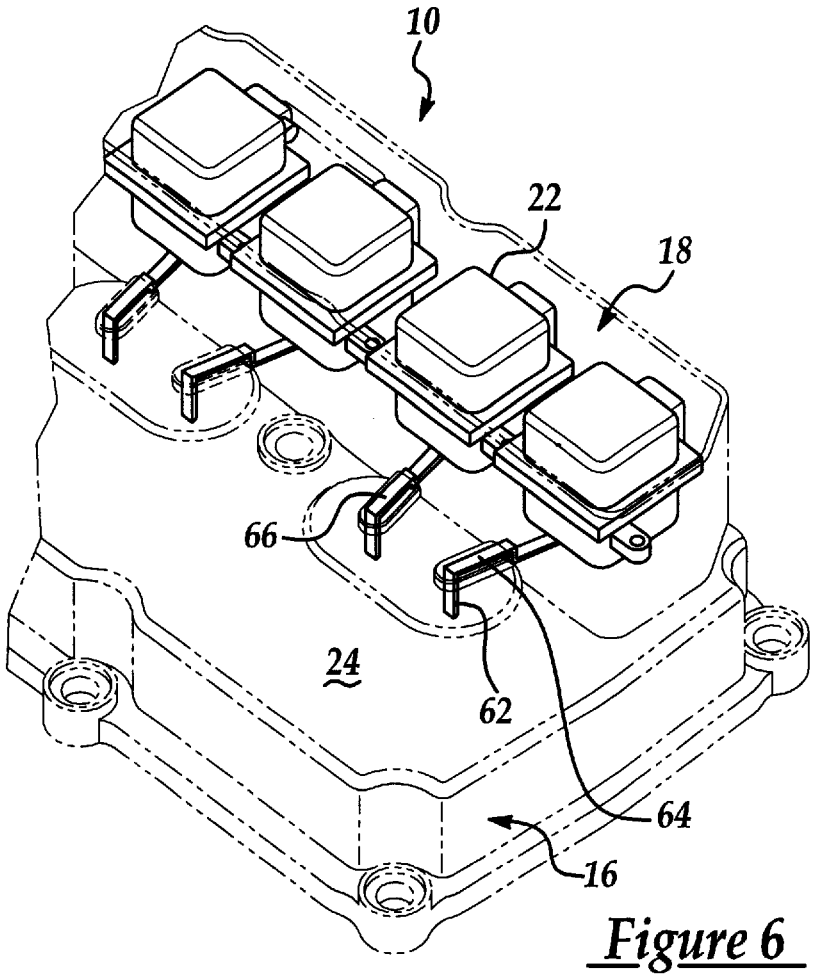
FIG. 6 is an enlarged, fragmentary. top perspective view as in FIG. 4, but showing the routing of the high voltage wiring molded into the rocker cover.
Figure 7:
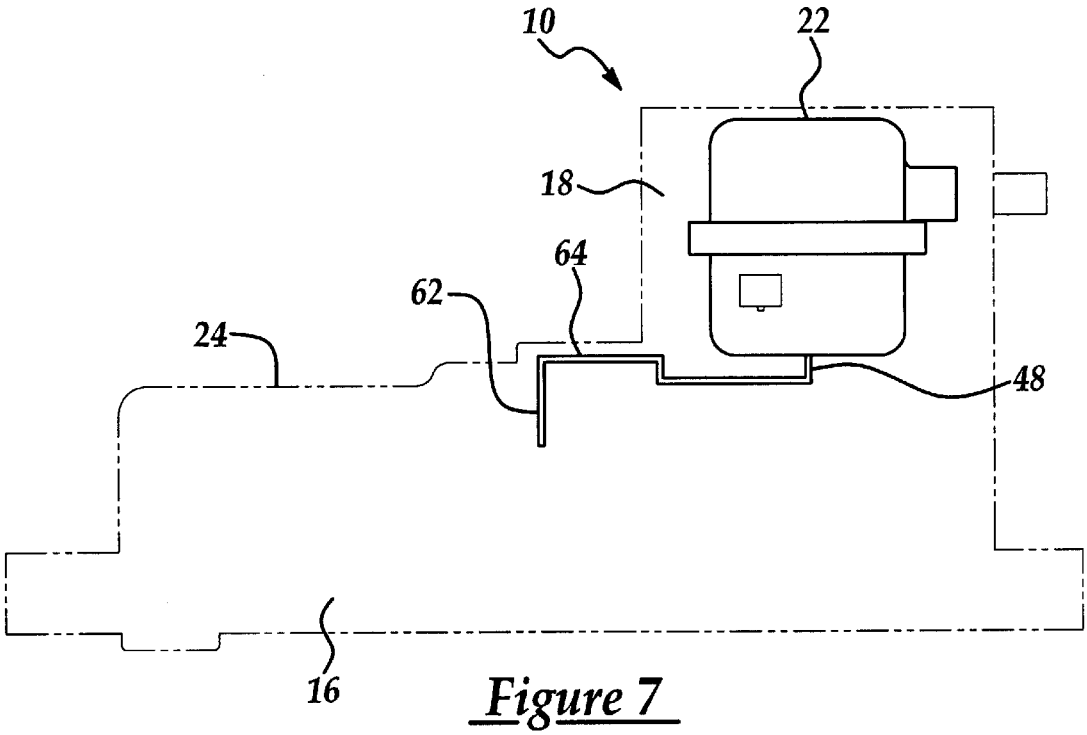
FIG. 7 is a side view of the of the rocker cover showing the routing of the high voltage wiring.
Figure 8:
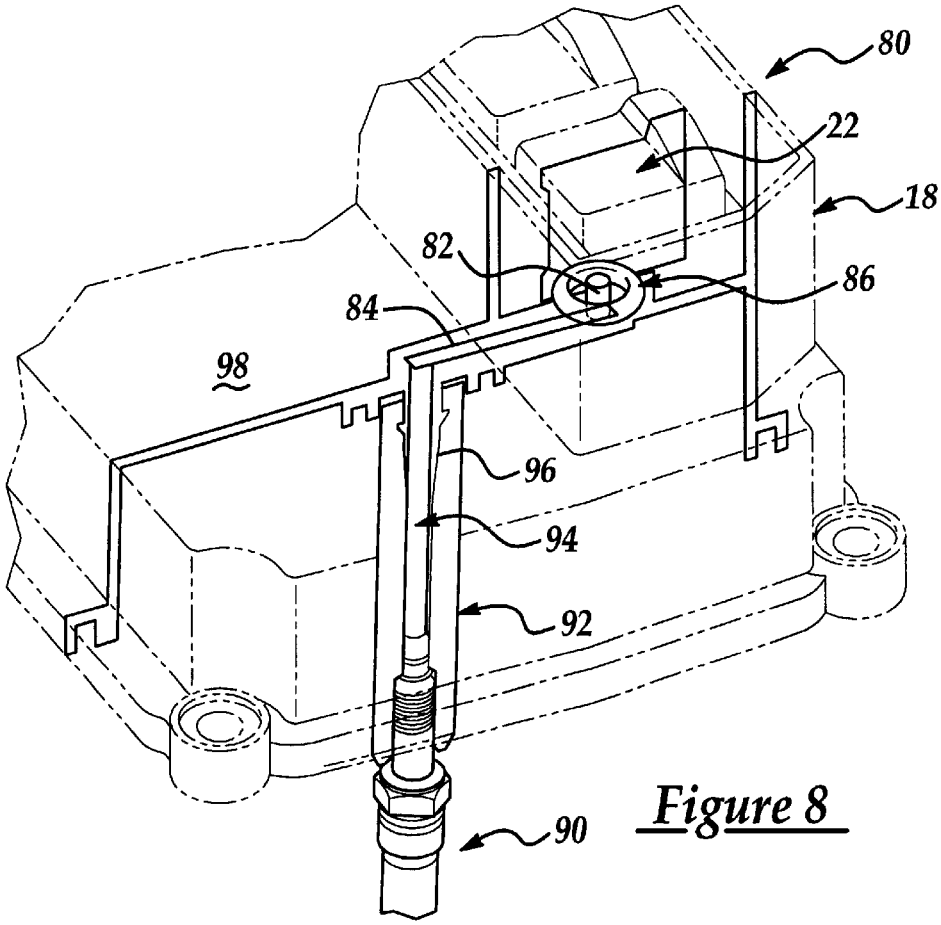
FIG. 8 is an enlarged, fragmentary top perspective view of an alternative embodiment of a rocker cover of the present invention, showing a more direct routing scheme for the molded-in high voltage wiring.

As shown in the bottom view of FIG. 5, the upper wall 24 includes an inner surface 60 which defines the upper-most extent of the interior region 20 that is located below the rocker cover. Protruding downward from inner surface 60 is a second group of high voltage terminals 62. Each of these terminals is associated with a corresponding one of the terminals 48 from the first group and each can also comprise a metal terminal blade. Turning now to FIGS. 6 and 7, rocker cover 10 includes a plurality of high voltage leads 64 molded into the upper wall 24 of housing 12. Each lead runs from one of the terminals 48 within the first group of terminals to one of the terminals 62 within the second group of terminals.

As shown, each high voltage lead and its associated terminals 48, 62 can comprise a unitary, electrically-conductive metal trace in the form of a flat metal strip 66 having a first end that constitutes its terminal 48 and a second end that constitutes its other terminal 62. The high voltage lead extends laterally along a length of the upper wall 24 from a location underneath the coil compartment to a location that is vertically aligned with its associated spark plug when the cover 10 is assembled in place on the engine. Of course, it will be appreciated that the lateral extent of the high voltage leads 64 will depend on the requirements of a particular application and that the coils could be mounted directly above their associated spark plugs so that the high voltage leads need not extend laterally through the upper wall 24.

Referring back momentarily to FIGS. 1–3, it will be seen that the upper wall 24 includes raised surface portions 68 that extend over the high voltage leads 64. These raised portions provide a thicker dimension to the plastic surrounding the high voltage leads which provides greater high voltage isolation as well as visually denoting the location of the embedded leads.

FIGS. 8–12 depict an alternative embodiment of a rocker cover 80 of the present invention which is substantially similar to that of FIGS. 1–7, with the primary differences being in the configuration of the high voltage ignition system components. Other than as expressly described below, all of the components of the rocker cover 80 can be constructed and utilized in the same manner as the corresponding components of rocker cover 10 of FIGS. 1–7.

Figure 9:
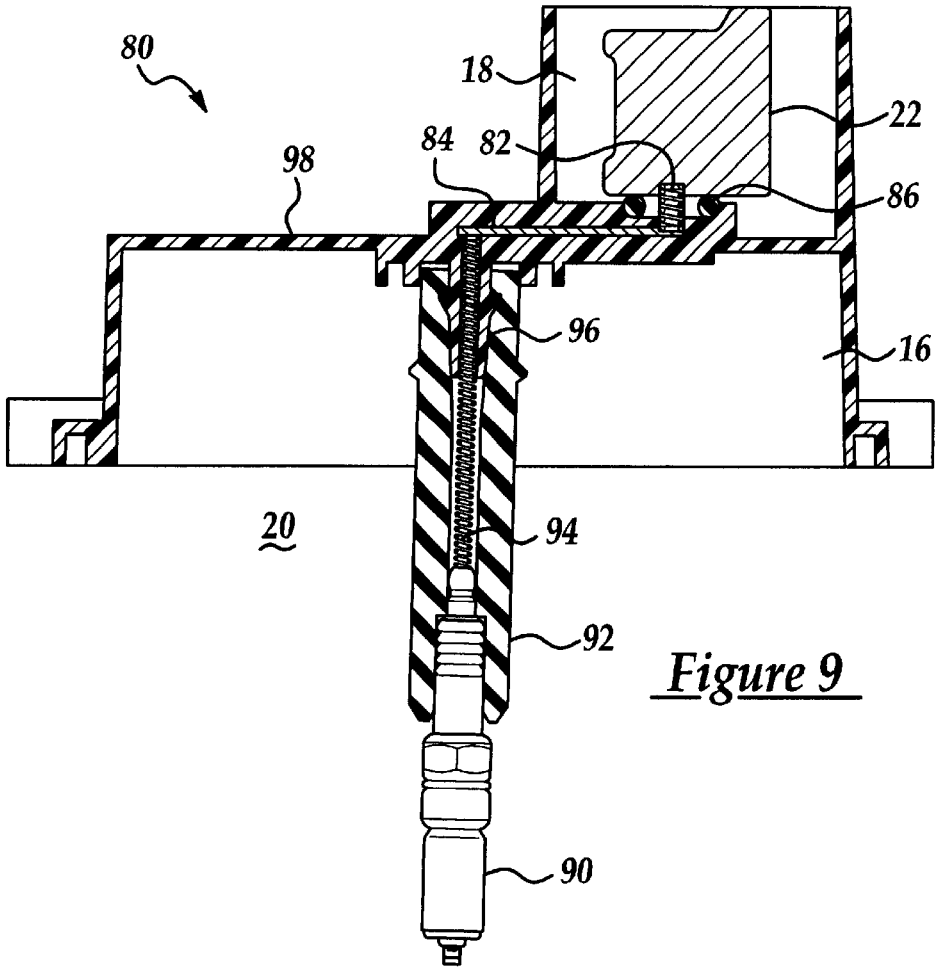
FIG. 9 is a side view of the rocker cover of FIG. 8.

In the embodiment of FIGS. 8–12, each of the coils 22 are electrically connected to their associated terminals within the coil compartment 18 by an electrically conductive compression spring 82 that directly contacts its associated molded-in high voltage lead 84. For this purpose, the leads 84 can include an upwardly protruding portion (as in the first embodiment) against which its compression spring seats, or, as best seen in FIG. 9, can simply include an exposed surface portion on which the compression spring rests. An elastomeric O-ring 86 is placed about the connecting spring 82 to protect the electrical connection against moisture and other environmental factors that could cause corrosion or shorting.

Figure 10:
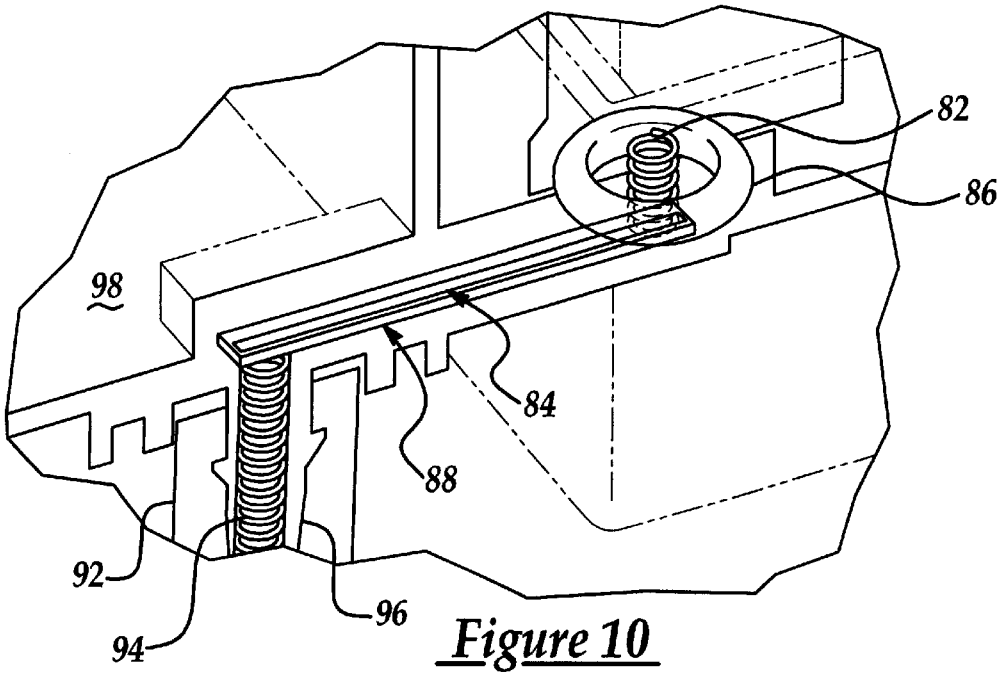
FIG. 10 is an enlargement of a portion of the rocker cover of FIG. 8 showing over-molding of the high voltage wiring.
Figure 11:
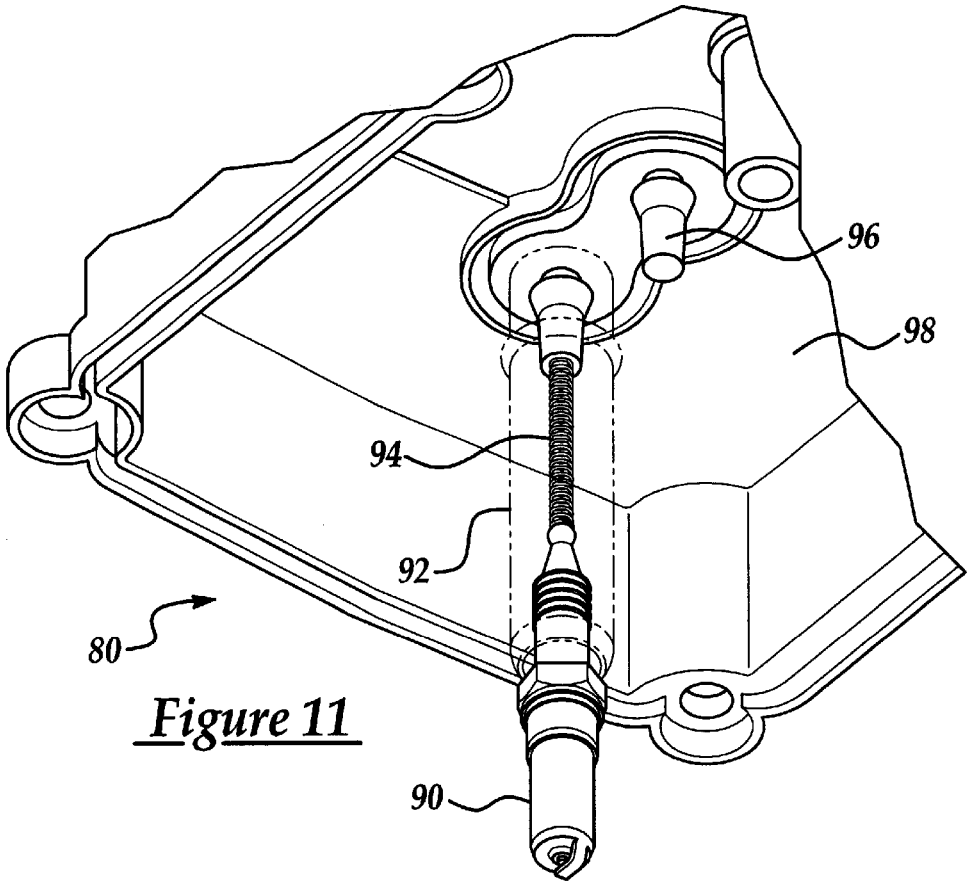
FIG. 11 is an enlarged, fragmentary, bottom perspective view of the rocker cover of FIG. 8 showing the boot and connecting spring used to connect the high voltage wiring of the rocker cover to an engine spark plug.
Figure 12:
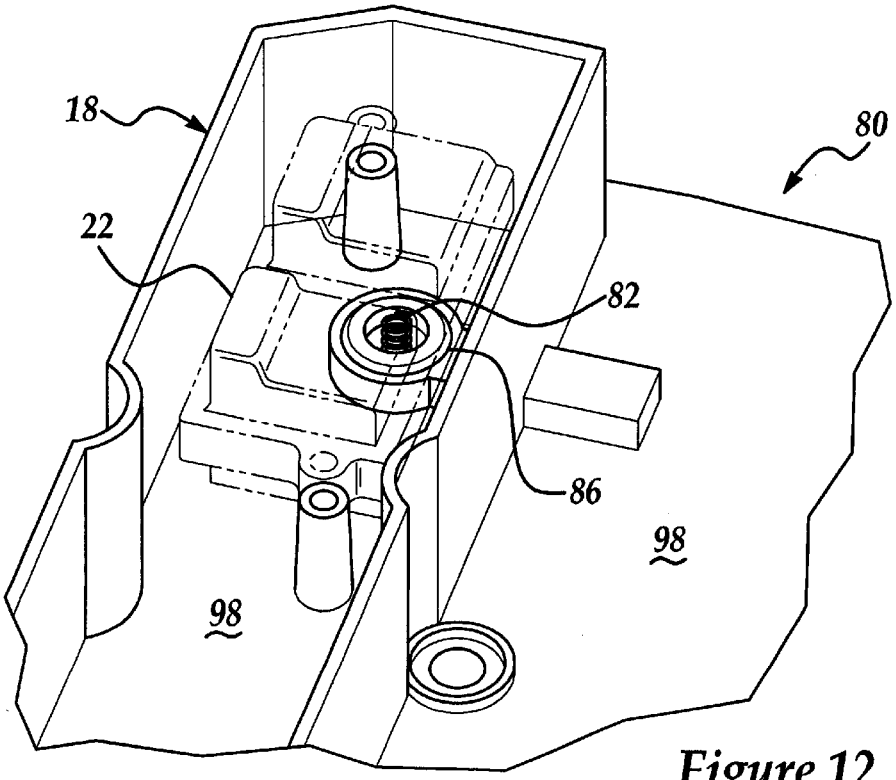
FIG. 12 is an enlarged, fragmentary, top perspective view of the rocker cover of FIG. 8 showing the mechanical mounting and electrical connection of an ignition coil within the coil compartment.

In both of the illustrated embodiments, the rocker cover is molded from a suitable plastic material such as Nylon 66 with stiffening ribs being utilized as necessary to obtain the desired structural rigidity. To obtain increased high voltage isolation of the leads embedded in the rocker cover housing, the leads can be first molded within a material preferably having a higher dielectric strength than the rocker cover material, with the over-molded leads then being insert molded within rocker cover housing. This is shown in FIG. 10. In particular, before molding of the rocker cover housing, each high voltage lead 84 is first over-molded in a separate operation using a material such as PET, PBT, PPO, PFA, or PA. The resulting over-molded lead is shown at 88 in FIG. 10. The over-molded leads 88 are then molded in place within the rocker cover housing using an insert molding process. This construction permits the housing 14 to be made from a plastic selected for its mechanical strength and resistance to various under-the-hood environmental factors, while the molded-in leads 84 are isolated using a plastic selected for its dielectric strength.

The electrical connection from each lead 64 to its associated spark plug 90 can be provided using a rubber boot 92 which contains a connecting spring 94 located internally within the boot. The rubber boot 92 fits over a quick-connect coupling 96 which can be a unitary portion of the rocker cover 80 that extends downwardly from the inner surface of its upper wall 98. Alternatively, coupling 96 can be a unitary extension of the higher dielectric strength material used in over-molding the high voltage leads. The connecting spring 94 extends through the boot, terminating near an expanded recess which is sized to fit over the terminal and insulator of the spark plug 90. The connecting spring 94 is sized so that when the cover 80 is assembled in place on the engine, the spring contacts and is compressed between the high voltage lead 84 and the terminal of spark plug 90. As will be appreciated, not only does this arrangement provide an integration of both the rocker cover and ignition system high voltage components, but it also simplifies installation since the assembly of the ignition coils 22 and even the rubber boots 92 onto the rocker cover can be carried out in advance, with the installation work at the vehicle being limited to first inserting the rocker cover in place on the engine so that the rubber boots 92 connect over their associated spark plug terminals, then securing the rocker cover via bolts through the mounting holes 34, and then connecting the coils to the remainder of the ignition system. Although not shown in FIGS. 1–7, the rubber boot arrangement of this second embodiment can be used in the first embodiment as well.

It will thus be apparent that there has been provided in accordance with the present invention an engine fluid compartment cover which achieves the aims and advantages specified herein. It will of course be understood that the foregoing description is of preferred exemplary embodiments of the invention and that the invention is not limited to the specific embodiments shown. Various changes and modifications will become apparent to those skilled in the art. For example, although the invention has been described as it could be implemented for a rocker cover, it could also be implemented using other engine fluid compartment covers. Also, although a molded plastic housing is shown in the illustrated embodiment, it will be appreciated that other housing materials can be used, such as aluminum or other metal with the high voltage leads then being isolated within a ceramic or other suitable dielectric material that is either molded into or secured to the housing. All such variations and modifications are intended to come within the scope of the appended claims.

We claim:

1. An engine fluid compartment cover for sealing an engine fluid within a compartment on a spark ignition internal combustion engine, comprising:

a housing having an upper wall and at least one side wall extending down from said upper wall to a mounting surface of said housing, wherein said mounting surface has a conformation that mates with an associated surface of an engine fluid compartment on the engine such that, when said housing is mounted to the engine with said mounting surface in contact with its associated surface on the engine fluid compartment, said upper and side walls together enclose the engine fluid within an interior region below said upper wall, and wherein said upper wall includes an inner surface facing said interior region and an outer surface facing upwardly from said upper wall;

a first group of high voltage terminals located at said outer surface;

a second group of high voltage terminals located at said inner surface, wherein each of said terminals in said first group is associated with a corresponding one of said terminals in said second group; and a plurality of high voltage leads secured to said upper wall of said housing between said inner and outer surfaces, each of said high voltage leads being associated with one of said terminals from said first group and one of said terminals from said second group, with said leads each being electrically connected at one end to its associated terminal from said first group and at another end to its associated terminal from said second group, whereby said leads provide electrical continuity between associated terminals from said first and second groups to thereby permit high voltage spark energy to be transmitted through said housing.

2. An engine fluid compartment cover as defined in claim 1, wherein each high voltage lead and its associated terminals together comprise a unitary, electrically-conductive metal trace.

3. An engine fluid compartment cover as defined in claim 2, wherein each of said metal traces comprise an elongated, flat metal strip with a first end of said strip comprising one of said terminals in said first group and a second end of said strip comprising one of said terminals in said second group.

4. An engine fluid compartment cover as defined in claim 3, wherein each of said ends of said strips comprises a terminal blade extending outward from its associated surface of said housing.

5. An engine fluid compartment cover as defined in claim 1, wherein at least one of said leads extends laterally along a section of said upper wall between said inner and outer surfaces, whereby the terminals associated with that lead are laterally spaced apart on said upper wall.

6. An engine fluid compartment cover as defined in claim 5, wherein said outer surface of said upper wall includes a raised surface portion extending over one or more of said leads, whereby said raised surface portion visually denotes the location of those leads.

7. An engine fluid compartment cover as defined in claim 1, wherein said upper wall is formed from a first plastic material with said leads being molded within a second plastic material that is molded within said upper wall, wherein said second plastic material has a higher dielectric strength than said first plastic material.

8. An engine fluid compartment cover as defined in claim 7, wherein said second plastic material is insert molded within said first plastic material.

9. An engine fluid compartment cover as defined in claim 1, further comprising a plurality of ignition devices mounted on said housing above said upper wall, said ignition devices being electrically connected to the terminals in said first group.

10. An engine fluid compartment cover as defined in claim 9, wherein said ignition devices are directly connected to the terminals in said first group.

11. An engine fluid compartment cover as defined in claim 10, wherein said ignition devices comprise ignition coils.

12. An engine fluid compartment cover as defined in claim 9, wherein said housing further comprises a compartment located above said upper wall, with said ignition devices being located within said compartment.

13. An engine fluid compartment cover as defined in claim 12, wherein said compartment includes one or more side walls and a removable cover.

14. An engine fluid compartment cover as defined in claim 12, wherein said one or more side walls of said compartment con.prise a unitary portion of said housing.

15. An engine fluid compartment cover as defined in claim 1, wherein said housing comprises a molded plastic housing and wherein said high voltage leads are molded into said upper wall of said housing.

16. An engine fluid compartment cover as defined in claim 1, wherein said mounting surface of said housing comprises an engine fluid sealing surface.

17. An engine cover for an overhead valve assembly of a spark ignition internal combustion engine, comprising:

a housing having a horizontally-extending upper wall and at least one side wall extending down from said upper wall to a mounting surface of said housing, wherein said mounting surface has a conformation that mates with an associated surface of the engine such that, when said housing is mounted to the engine with said mounting surface in contact with its associated surface, said upper and side walls together enclose the overhead valve assembly within an interior region below said upper wall, said housing including an enclosed compartment extending upwardly from said upper wall;

a first group of high voltage terminals located in said compartment;

a plurality of ignition devices mounted in said compartment, each of said ignition devices being electrically connected to at least one of the terminals in said first group;

a second group of high voltage terminals located below said upper wall, wherein each of said terminals in said first group is associated with a corresponding one of said terminals in said second group; and a plurality of high voltage leads, each of said high voltage leads being associated with one of said terminals from said first group and one of said terminals from said second group, wherein said leads are each electrically connected at one end to its associated terminal from said first group and at another end to its associated terminal from said second group, whereby said leads provide electrical continuity between associated terminals from said first and second groups to thereby permit high voltage spark energy to be transmitted through said upper wall from said compartment to said second group of terminals.

18. An engine cover as defined in claim 17, wherein said wherein said upper wall comprises a bottom wall of said compartment and wherein said compartment includes a removable cover and one or more vertically-extending side walls that are unitary with said upper wall.

19. An engine cover as defined in claim 17, wherein said engine cover includes one ignition device for each of said terminals from said second group.

* * * * *

UNITED STATES PATENT AND TRADEMARK OFFICE

CERTIFICATE OF CORRECTION

PATENT NO. : 6,494,193 B2 
DATED : December 17, 2002
INVENTOR(S) : Juergen Weingaertner and James D. Lykowski It is certified that error appears in the above-identified patent and that said Letters Patent is hereby corrected as shown below:

Column 3,
Line 25, after "said" delete "of the".

Column 8,
Line 3, after "compartment" delete "con.prise" and insert therein -- comprise --.
Line 51, after "claim 17," delete "wherein said".

Signed and Sealed this

Fifteenth Day of July, 2003

JAMES E. ROGAN
*Director of the United States Patent and Trademark Office*